US008191534B2

(12) United States Patent
Gokhale et al.

(10) Patent No.: US 8,191,534 B2
(45) Date of Patent: Jun. 5, 2012

(54) HIGH VISCOSITY FUEL INJECTION PRESSURE REDUCTION SYSTEM AND METHOD

(75) Inventors: Manoj Prakash Gokhale, Bangalore (IN); Bryan Thomas Jett, Erie, PA (US)

(73) Assignee: General Electric Company, Schenectady, NY (US)

( * ) Notice: Subject to any disclaimer, the term of this patent is extended or adjusted under 35 U.S.C. 154(b) by 1134 days.

(21) Appl. No.: 12/039,179

(22) Filed: Feb. 28, 2008

(65) Prior Publication Data

US 2009/0217912 A1 Sep. 3, 2009

(51) Int. Cl.
*F02M 55/02* (2006.01)

(52) U.S. Cl. ..... 123/468; 123/575; 123/576; 123/510; 123/511; 123/544

(58) Field of Classification Search ..... 123/575, 123/576, 577, 578, 510, 511, 512, 513, 515, 123/502, 445, 447, 27 R, 28 GE, 457, 297, 123/304, 468, 469, 470, 543, 544, 545, 547, 123/456, 467, 458, 514, 530, 546, 179.7, 123/179.8, 179.9; 440/88 F
See application file for complete search history.

(56) References Cited

U.S. PATENT DOCUMENTS

| | | | | |
|---|---|---|---|---|
| 3,022,425 | A * | 2/1962 | Rockstead | 290/40 R |
| 4,115,616 | A * | 9/1978 | Heitz et al. | 442/224 |
| 4,161,161 | A * | 7/1979 | Bastenhof | 123/447 |
| 4,321,905 | A * | 3/1982 | Kurasawa | 123/575 |
| 4,705,010 | A * | 11/1987 | Baranescu | 123/575 |
| 4,825,830 | A | 5/1989 | Elsbett et al. | |
| 5,092,305 | A * | 3/1992 | King | 123/575 |
| 5,709,194 | A | 1/1998 | Moncelle | |
| 5,826,561 | A | 10/1998 | Mack et al. | |
| 6,588,406 | B2 * | 7/2003 | Oprea | 123/525 |
| 6,644,282 | B2 | 11/2003 | Schwarz | |
| 6,729,302 | B2 | 5/2004 | Willmann et al. | |
| 6,823,847 | B2 | 11/2004 | Carlo | |

(Continued)

FOREIGN PATENT DOCUMENTS

DE 3800585 * 7/1988

(Continued)

OTHER PUBLICATIONS

Munson et al., Fundamentals of Fluid Mechanics, 2006, Wiley & Sons, Inc., Fifth Edition, 327-329.*

(Continued)

*Primary Examiner* — Stephen K Cronin
*Assistant Examiner* — Raza Najmuddin
(74) *Attorney, Agent, or Firm* — GE Global Patent Operation; John A. Kramer

(57) ABSTRACT

An improved high viscosity fuel injection pressure reduction system and method is disclosed for use in an internal combustion engine. The system may include a first fuel line and a second fuel line. The first fuel line may be configured to be coupled upstream of a combustion chamber of the engine when the engine is operated with the first fuel and to provide a first pressurized volume when installed. Likewise, the second fuel line may be configured to be coupled upstream of the combustion chamber of the engine when the engine is operated with the second fuel and to provide a second pressurized volume when installed. The first and second volumes of the fuel lines may provide peak injection pressures lower than a desired pressure when the engine is operated with the first and second fuels, respectively.

20 Claims, 5 Drawing Sheets

U.S. PATENT DOCUMENTS

| | | | | |
|---|---|---|---|---|
| 7,913,664 | B2 * | 3/2011 | Williams et al. | 123/304 |
| 8,006,677 | B2 * | 8/2011 | Williams et al. | 123/575 |
| 2002/0179063 | A1 | 12/2002 | Willmann et al. | |
| 2003/0051709 | A1 | 3/2003 | Yu | |
| 2003/0116136 | A1 | 6/2003 | Schwarz | |
| 2004/0055577 | A1 | 3/2004 | Carlo | |

FOREIGN PATENT DOCUMENTS

| | | | |
|---|---|---|---|
| DE | 3800585 | A1 | 7/1988 |
| DE | 3929115 | A1 | 3/1991 |
| DE | 10154455 | A1 | 5/2003 |
| DE | 102006040466 | A1 | 3/2008 |
| DE | 102007028091 | A1 | 12/2008 |
| WO | 20070109914 | A1 | 10/2007 |
| WO | WO 2007109914 | * | 10/2007 |

OTHER PUBLICATIONS

Anonymous, Technology Review Wartsila 32DF, 2007, pp. 1-16, Wartsila, Finland OY.

Anonymous, The compact economy, Viertakt Dieselmotor, Mar. 1995, pp. 1-8, V32/40, Man B&W Diesel AG.

International Search Report issued in connection with corresponding PCT Application No. PCT/US2009/032011 on Jul. 2, 2009.

International Written Opinion issued in connection with corresponding PCT Application No. PCT/US2009/032011 on Jul. 2, 2009.

* cited by examiner

HIGH VISCOSITY FUEL INJECTION PRESSURE REDUCTION SYSTEM AND METHOD

BACKGROUND

The invention relates generally to the field of internal combustion engines designed to use different fuels having different combustion properties. More particularly, embodiments of the present invention relate to a high viscosity fuel injection pressure reduction system and method that may be implemented for using alternate fuels in engines such as diesel engines.

Internal combustion engines are used for many different applications, including the generation of electrical power and the propelling of vehicles over land and sea. Electrical generator sets may be used in a variety of such applications to generate power used in various loads, including the driving of electric motors in vehicles such as locomotives, sea-going vessels, and so forth. Such internal combustion engines may include diesel engines that are configured to operate with a specific type of diesel fuel. For example, the commercial marine industry has developed tailored marine fuels that are more cost effective for the diesel engines used in marine applications. Moreover, the types of diesel fuels and their physical properties may vary from industry to industry. In addition to operating on such varied diesel fuel standards, some engines may be called upon to operate on other types of fuels, such as various combustible oils.

Poor engine performance or engine damage may result if the wrong type of diesel fuel is used in a diesel engine not designed to operate on such fuels. For example, using a marine diesel fuel in a locomotive application may increase peak injection pressures within the injection system because of the higher viscosity of the marine diesel fuel. However, it may indeed be desirable to configure a diesel engine so that it may be implemented in either application (i.e., a railroad locomotive or a marine vessel). One method for reducing the injection pressure within the fuel injection system is to preheat the fuel to reduce its viscosity. However, components for pre-heating the fuel take up valuable space and increase the weight of the vehicle. Additionally, pre-heating is a somewhat delicate process that increases the cost and complexity of the engine system. There is a need in the art for approaches to engine design and configuration that permit different fuels to be utilized on particular engines while respecting injection pressure and other design parameters.

BRIEF DESCRIPTION

The present invention provides a system and method for configuring an internal combustion engine so that it may be used with more than one type of fuel without increasing the cost or the complexity of the engine system, and still maintaining operating parameters, particularly injection pressures within design limits. Embodiments of the present invention provide an improved high viscosity fuel injection pressure reduction system and method. In general, the system may include an internal combustion engine, a first fuel line, and a second fuel line. The internal combustion engine may be configured to operate by combustion of a first fuel or a second fuel. Further, the first fuel line may be configured to be coupled upstream of a combustion chamber of the engine when the engine is operated with the first fuel and to provide a first pressurized volume when installed. Likewise, the second fuel line may be configured to be coupled upstream of the combustion chamber of the engine when the engine is operated with the second fuel and to provide a second pressurized volume when installed. The first and second volumes of the fuel lines provide peak injection pressures lower than a desired pressure when the engine is operated with the first and second fuels, respectively.

In particular, certain embodiments of the present invention contemplate a desired pressure. Further, embodiments of the present invention contemplate that the volume of the first fuel line is, for example, approximately 3000 to 3300 cubic millimeters and the volume of the second fuel line is between approximately 5000 and 5300 cubic millimeters, although other volumes may be used. Additionally, the first and second volumes may include an internal volume of an injector assembly that includes a plurality of flow paths. Use of a different injector may add volumes of the order of 4000 cubic millimeters, for a total difference on the order of over 6000 to 7000 cubic millimeters.

The high viscosity fuel injection pressure reduction system may be configured to operate with at least two different fuels having different physical properties (e.g., kinematic viscosity, density). For example, the first fuel may be a diesel fuel (e.g., number 1 or number 2 diesel fuel) and the second fuel may be any of a number of alternative fuels (e.g., marine diesel fuel, marine diesel oil, intermediate fuel oil, residual fuel oil, marine gas oil, or vegetable oil). The kinematic viscosity of the first fuel may fall between 1 to 6 centistokes at 40 degree centigrade and the kinematic viscosity of the second fuel is between 6 to 50 centistokes at 40 degree centigrade.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
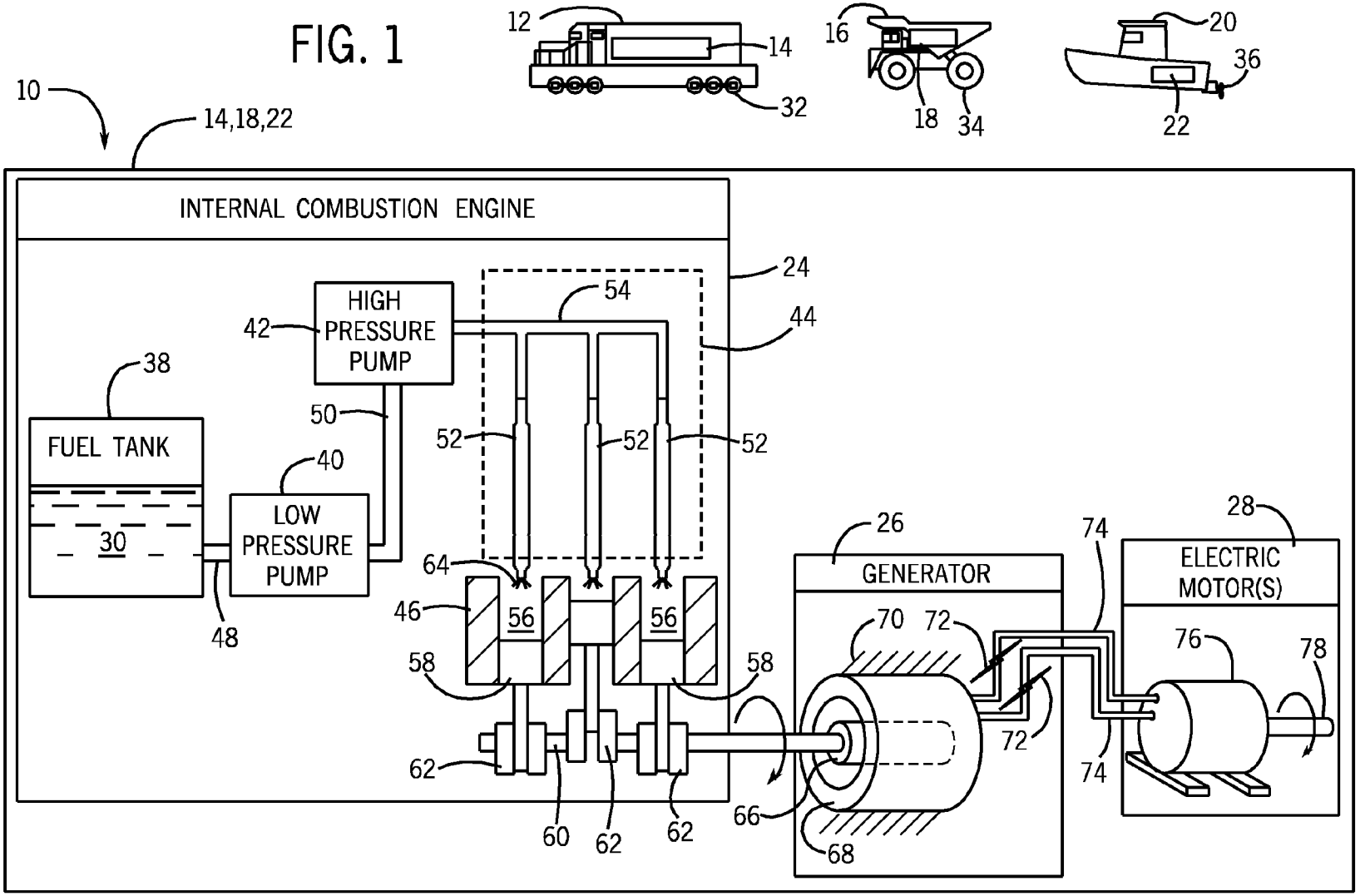
FIG. 1 is a diagram of a high viscosity fuel injection pressure reduction system in accordance with embodiments of the invention, illustrating an exemplary arrangement in the form of an electrical generator set that includes an internal combustion engine, a generator, and an electric motor.

Turning to the drawings and referring to FIG. 1, an embodiment of a high viscosity fuel injection pressure reduction system is illustrated and designated generally by the reference numeral 10. System 10 may include a generator set that may be used to supply power to electrical loads, such as for a number of different drive system applications. For example, system 10 may be included as part of generator set 14 to drive railroad locomotive 12. Likewise, system 10 may be included in either generator set 18 or 22 to drive a mining transport vehicle 16 or to propel marine transport vessel 20, respectively.

In general, generator sets 14, 18, 22 may include an internal combustion engine 24 that is mechanically coupled to a generator 26, which is further electrically coupled to downstream loads, such as one or more electric motors 28. This configuration allows generator sets 14, 18, 22 to provide mechanical power to the drive systems via a multi-step power conversion process. As will be appreciated by those skilled in the art, in such processes, first, the chemical energy of a fuel 30 is converted to a mechanical energy or power via internal combustion engine 24. The mechanical energy is then converted to electrical energy or power via the mechanical coupling of engine 24 to generator 26. The electrical energy created via generator 26 may then be used by electrical loads, such as motor 28, to drive a mechanical component of the system or, more generally, for any other purpose. For example, the electrical motor 28 may drive wheels 32 of locomotive 12, wheels 34 of mining transport vehicle 16, or a propulsion mechanism 36 of marine transport vessel 20.

As discussed above, the chemical energy of fuel 30 is converted to mechanical energy via internal combustion engine 24. Internal combustion engine 24 may have a fuel tank 38 for storing fuel 30, a low pressure pump 40, a high pressure pump 42, an engine injection system 44, and an engine assembly 46. Internal combustion engine 24 may be a diesel engine, a gasoline engine, a hybrid engine, or an engine designed to function with other combustible fuels. Therefore, fuel 30 contained in the fuel tank 38 may be a gasoline-based fuel, a diesel fuel, a bio-fuel or any other combustible depending on the type of engine implemented. However, because diesel engines are often included in generator sets 14, 18, 22 a brief discussion on the different variations of diesel fuels follows. Specifically, the discussion includes the variations of distillate, residual, or intermediate classifications of diesel fuels.

Distillate fuels are one category of diesel fuels that may, in certain conventional refining processes, be produced during the distillation process or "boiling off" of the crude oil. The distillate fuels may be categorized to include a diesel fuel category and a marine diesel oil category. Examples of the diesel fuel category include number 1 diesel (sometimes denoted "no. 1-D") and number 2 diesel (sometimes denoted "no. 2-D"). No. 1-D is typically a land-based diesel fuel that is produced for highway automotive use and typically includes low sulfur content. No. 1-D may be preferred in colder climates where engine starting may be difficult with no. 2-D. However, no. 2-D fuel is more common for automotive use because of its higher energy output and natural lubricity. Additionally, no. 2-D may be produced with higher sulfur content (to reduce production cost) and used for non-highway applications. For example, no. 2-D may be used to power the diesel engines of railroad locomotives, earth moving equipment, farm equipment, or stationary generators.

In contrast, marine diesel oils are a second category of fuels and are the "heavier" or higher boiling-point distillate fractions. It should be noted, that while the term "diesel fuel" for land-based applications such as automobiles generally refers to a 100 percent distillate, this is not the case in the marine industry where the term "marine diesel fuel" often refers to a blend of distillate and residual oils. Distillate fuels may be defined to include the fractions of crude oil that is separated or boiled off during the distillation process, whereas residual fuels may be defined to include one or more fractions that did not boil off. Thus, residual fuels are sometimes referred to as "tar" or heavy fuel oil. Marine diesel oils may be referred to as marine diesel oil (MDO) or intermediate fuel oil (IFO) and may be further described as "low viscosity" residual marine fuel oil. However, "low viscosity" is a relative term and the viscosity of MDO is often significantly higher (e.g., as much as three times or greater) than that of other diesel fuels. Further, each blend of the intermediate fuel or MDO may include unique physical properties. Therefore, these intermediate fuels are often produced to national and international specifications and graded. The most common grades are IFO-180 and IFO-380.

As implied by the different fuel categories, no 2-D diesel fuel often has very different physical, chemical and energetic properties than those of IFO or MDO grades. For example, these fuel categories have very different flash points, kinematic viscosities, percentage of sulfur content, and cetane numbers. Specifically, marine diesel fuels are required to have a minimum flash point of 60 degrees centigrade for safety and transport reasons. In contrast, no 2-D fuels generally have a flash point of 52 degrees centigrade. Similarly, MDO's generally have a higher kinematic viscosity, in the range of 6 to 15 centistokes at 40 degrees centigrade, when compared to other diesel fuels, in the range of 1 to 6 centistokes at 40 degrees centigrade.

As will be discussed in more detail, differences in the properties of the fuels may affect engine performance and engine life. In other words, the fuel is often produced to operate in specific engines and for specific applications. Similarly, engines are typically designed to function with one or a limited number of fuels, and can be damaged if other fuels are employed. Therefore, embodiments of the present invention are advantageous because they enable an operator to use the same diesel engine for multiple applications and fuels. In other words, the same internal combustion engine may be configured to operate with a first fuel to meet desired operating parameters (e.g., design pressure limits) and may be further configured, factory assembled, or retrofitted to operate with a second fuel to meet the same or similar desired operating parameters. Such fuels may include different types of diesel fuels and oils. Moreover, the internal combustion engine may be configured to operate with a bio-fuel, such as vegetable oil, and still meet the same or similar desired operating parameters.

Referring to FIG. 1 and continuing with the description of the system illustrated therein, low pressure pump 40 is coupled to fuel tank 38 via a low pressure fuel line 48. Further, low pressure pump 40 is coupled to high pressure pump 42 via a second low pressure fuel line 50. Thus, low pressure pump 40 may deliver fuel 30 from fuel tank 38 to high pressure pump 42 via pressure lines 48 and 50. High pressure pump 42 then supplies a pressurized volume of fuel 30 to injection system 44. Injection system 44 may include high pressure injectors 52 and high pressure lines 54 to deliver the fuel to the engine assembly 46. As indicated, pressure injectors 52 and pressure line 54 are designed to operate under an elevated pressure and may be designed for a desired operating pressure ( ) and rated for a peak or maximum pressure. In other words, pressure injectors 52 and pressure line 54 may have a limited life if the peak pressure exceeds the desired operating or limit pressure. Likewise, the high pressure pump 42 may also be designed for a desired operating pressure and have a limited life span if the peak pressure of the system exceeds the desired operating pressure. Finally, high pressure injectors 52 deliver fuel 30 to engine assembly 46 where it is joined with oxidant (e.g., air) and combusted in a combustion chamber (e.g., an engine cylinder).

Engine assembly 46 includes combustion chambers or barrels 56 and pistons 58. Pistons 58 are further coupled to a drive shaft 60 via a crank shaft 62. The crank shaft 62 enables the pistons 58 to reciprocate within combustion chamber 56. Thus, operation of high pressure injector 52 is timed to introduce a portion of the pressurized volume of fuel 64 into chamber 56 when piston 58 is in the desired position to facilitate fuel combustion. The desired position is typically when piston 58 reaches a point near top dead center (TDC) or its maximum in-cylinder position. The combustion of pressurized fuel 64 then drives piston 58 to cause drive shaft 60 to rotate. As will be discussed in more detail below, the introduction of pressurized fuel 64 into chamber 56 is controlled by a valve included in injector 52. The time period that the valve remains open is a function of a fuel cam angle (not shown) and the pressure of the fuel contained within the injection system 44. This time period will typically also be a function of the particular fuel utilized and its properties (e.g., heating value, flow properties, atomization properties).

The mechanical energy of the internal combustion engine 24 may then be converted into electrical energy via generator 26. Generator 26 may include a rotor 66 and a stator 68 which may be included in a fixed housing 70. The rotation of rotor 66 creates an electrical energy 72 in the coils of stator 68 via electromagnetic induction. Electrical energy 72 may then be stored by batteries (not shown) or may be used by loads such as electrical motor 28.

Electrical motor 28 includes electrical connections 74 to electrically couple the motor to generator 26. Electrical motor 28 may include a housing 76 for supporting a rotor and stator (not shown) in a similar manner to that of generator 26. Further, electrical motor 28 includes a shaft 78 which may be used to drive the wheels 32 of locomotive 12, the wheels 34 of mining vehicle 16, or the propulsion system 36 of vessel 20, among many possible applications.

Figure 2:
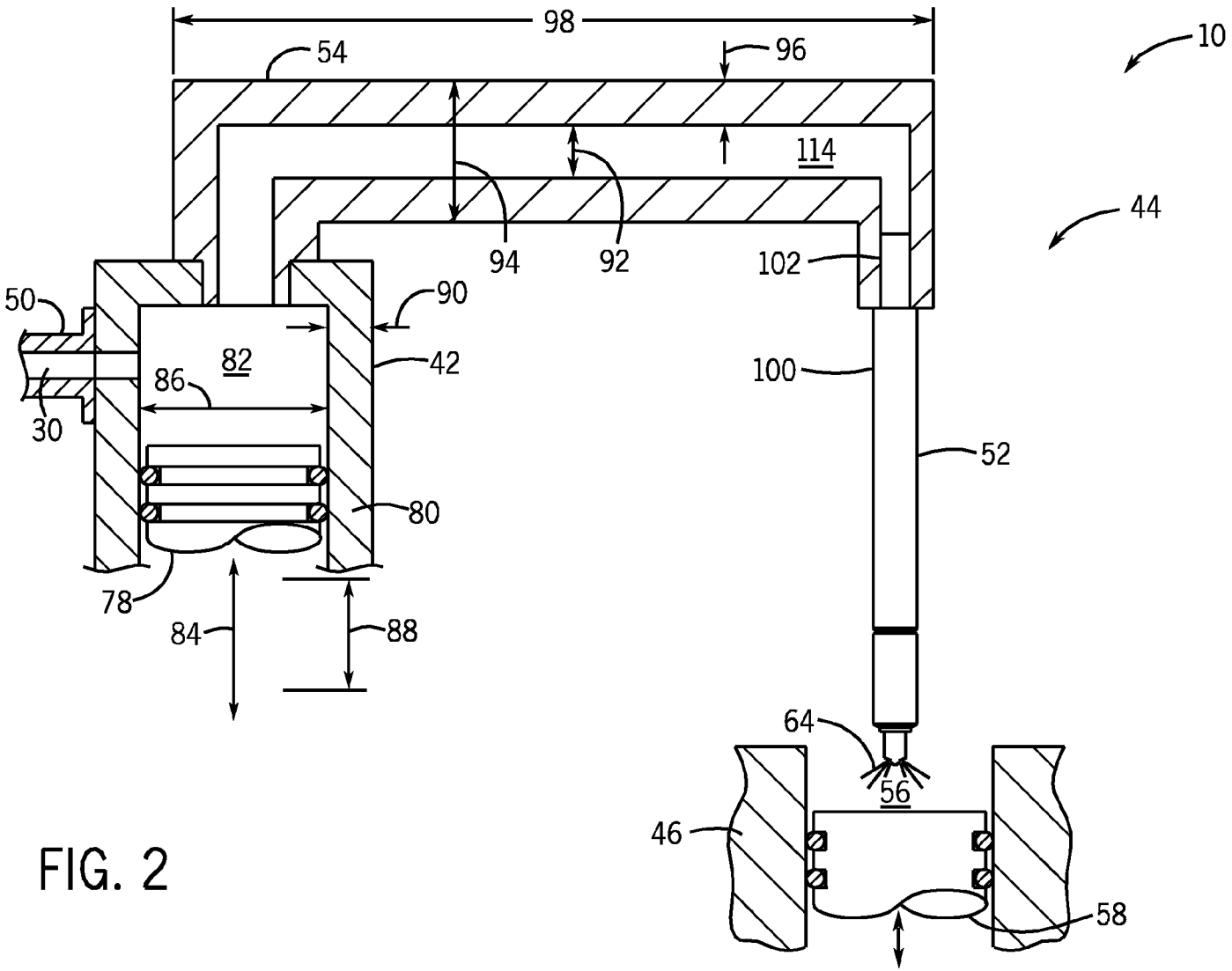
FIG. 2 is a diagram of a high viscosity fuel injection pressure reduction system in accordance with embodiments of the invention, illustrating an injection system of an internal combustion engine that includes a high pressure pump, a fuel line, and a fuel injector.

FIG. 2 illustrates one embodiment of the high viscosity fuel injection pressure reduction system 10. In this embodiment, system 10 includes a high pressure pump 42 coupled to high pressure injector 52 via high pressure line 54. As discussed above, high pressure injector 52 provides a pressurized volume of fuel 64 into combustion chamber 56 of engine assembly 46. FIG. 2 illustrates a positive displacement pump configuration for high pressure pump 42. However, embodiments of the present invention are not limited to any particular type of pump and any suitable, conventional pump may be employed. In the illustrated embodiment, pump 42 includes plunger 78 that is enclosed by a pump housing 80 to form a pressurized chamber 82.

Pressurized chamber 82 enables plunger 78 to displace a volume of fuel 30 contained in the chamber by reciprocating motion, generally represented by reference numeral 84. The reciprocating motion of plunger 78 compresses fuel 30 and causes a pressure increase in the components of the injection system 44. That is, the pressure increases within the high pressure pump 42, high pressure line 54, and high pressure injector 52. These components are configured for a desired operating pressure that includes a peak pressure of the injection system 44. The peak pressure may be a function of the kinematic viscosity and the density of fuel 30. For example, an increase in the kinematic viscosity of the fuel may result an increase in the peak pressure of the system because the internal volume of the injection system 44 remains fixed. Therefore, the peak pressure may also be a function of internal chamber diameter 86 and travel of plunger 78, generally represented by reference numeral 88, the internal volumes of which define the volume in which the pressurized fuel is confined. In other words, the peak pressure may be determined by both the physical properties of fuel 30 and the mechanical configuration of the components of the injection system 44.

A presently contemplated embodiment of the present invention is configured for a certain operating pressure or desired pressure from in excess of approximately 1000 bar. That is, the components of the injection system 44 have an acceptable operating life when the peak pressure remains below the desired pressure or pressure ratings of each of the individual components. For example, the pressure rating of pump housing 80 is determined by wall thickness 90 and internal chamber diameter 86. Similarly, the pressure rating for high pressure line 54 is determined by inside diameter 92, outside diameter 94, and wall thickness 96. Further, high pressure line 54 includes a length 98 that, with the internal diameter, determines the volume of the line in which the pressurized fuel is confined. It should be noted that FIG. 2 is a general representation of the components of the injection system 44 and is not drawn to scale.

Figure 3:
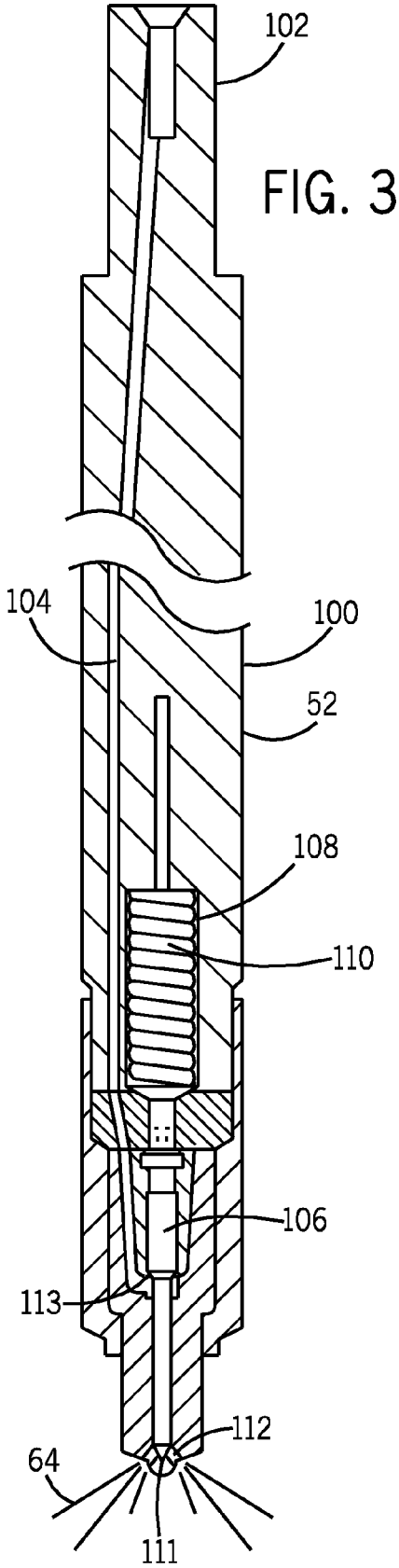
FIG. 3 illustrates an embodiment of a high pressure fuel injector in accordance with contemplated embodiments of the present invention.

FIG. 3 illustrates an embodiment of a high pressure fuel injector in accordance with certain presently contemplated embodiments of the present invention. As with the other components of injection system 44, the pressure rating for high pressure injector 52 is determined by the mechanical configuration of the injector and its components. High pressure injector 52 includes a nozzle body 100 having coupling feature 102 that places the internal volume of high pressure line 54 in fluid communication with internal fuel passage 104. This communication enables the high pressure injector 52 to deliver the pressurized fuel 64 to the combustion chamber 56 of the engine assembly 46. Specifically, high pressure injector 52 includes a needle valve 106 and a spring chamber 108 for housing spring 110. Needle valve 106 includes a front surface 111 that interfaces with injection holes 112 of nozzle body 100. Needle 106 is considered to be in a closed position when front surface 111 is mated against injection holes 112. Further, spring 110 provides a biasing force that keeps needle 106 in this closed position to contain fuel 30 within nozzle body passage 104.

Needle valve 106 may be displaced to an open position when the pressure in the internal chamber 104 reaches a limit that overcomes the force provided by spring 110. Specifically, this occurs when the pressure inside internal chamber 104 generates enough force against pressure shoulder 113 to displace needle valve 106. Once the pressurized fuel 64 is expelled into chamber 56, the pressure in the internal chamber 104 can no longer sustain the force provided by spring 110 and needle valve 106 returns to a closed position.

As noted above, the desired operating pressure and operating parameters of the fuel injection system 44 are determined by both the mechanical configuration of the system and the physical properties of the fuel used in the system. Therefore, embodiments of the present invention provide for an injection system 44 that may be configured and selected based on the physical properties of the fuel. That is, the same engine may be used for a variety of applications that make use of different fuels. Specifically, engine 24 may be configured for a first fuel by installing a first fuel line, and may be configured for a second fuel by installing a second fuel line. The difference in the fuel lines being the internal volumes provided to the injection system as determined by the mechanical configuration of the lines (e.g., inside diameter 92, outside diameter 94, and length 98). Additionally, as discussed in more detail below, the internal volume of the injection system may be increased or decreased via alternate embodiments of injector 52.

In sum, the internal volume of injection system 44 generally includes three internal chambers that, based upon the compressibility of the particular fuel used, determine the operating pressure or peak pressure of the system. Specifically, operating chamber 82 of the high pressure pump 42, internal volume 114 of the high pressure line 54, and internal passage 104 of the high pressure fuel injector 52. Thus, embodiments of the present invention provide that the peak pressure may be reduced in the internal volume of injection system 44 by increasing the volumes in any of these chambers. More generally, the engine may be selectively configured for specific fuels, while respecting design pressure limits, by installing high pressure fuel line components that provide an internal volume sized for the particular fuel.

For example, a higher peak pressure may result in injection system 44 when a low viscosity fuel is replaced with a higher viscosity fuel. The higher viscosity fuel will typically tend to increase the peak pressure. Thus, in accordance with embodiments of the present invention the internal volume of the injection system may be increased to accommodate such fuels, and reduce peak pressures by selecting from at least two interchangeable fuel lines, the selection being based, for example, upon the viscosity or compressibility of the fuel that will be used to power the engine. The result is that the selected fuel line provides a peak injection pressure lower than a desired operating pressure. (For example, embodiments of the present invention contemplate the first fuel line having an internal volume between, for example, approximately 3000 to 3300 cubic millimeters and the volume of the second fuel line is between approximately 5000 and 5300 cubic millimeters, although other volumes may be used. Additionally, the first and second volumes may include an internal volume of an injector assembly that includes a plurality of flow paths. Use of a different injector may add volumes of the order of 4000 cubic millimeters, for a total difference on the order of over 6000 to 7000 cubic millimeters. In certain embodiments of the present invention the increase in the volume of the second fuel line was obtained by making the inside diameter of the second fuel line one millimeter larger than the inside diameter of the first fuel line. The smaller of these lines was selected to operate with a lower viscosity fuel (such as number 1 or number 2 diesel fuel), while the larger was selected to operate with a higher viscosity fuel (such as marine diesel fuel, marine diesel oil, intermediate fuel oil, residual fuel oil, marine gas oil, or vegetable oil). However, embodiments of the present invention are not limited to either these internal volumes or diameters and one of the advantages of the technique is the flexibility provided by fuel line selection.

As previously discussed, one possible method for reducing the peak pressure is to reduce the viscosity of the fluid via pre-heating the fuel before introducing the fuel into injection system 44. However, pre-heating of the fuel increases the cost and the complexity of the system and engine. Therefore, embodiments of the present invention provide the advantage of eliminating fuel heating components. In other words, embodiments of the present invention provide a system that may reduce the cost and complexity of an engine system that is powered via a high viscosity fuel. Again, these high viscosity fuels may include not only MDO and IFO, but also vegetable oil or other bio-fuels.

Figure 4:
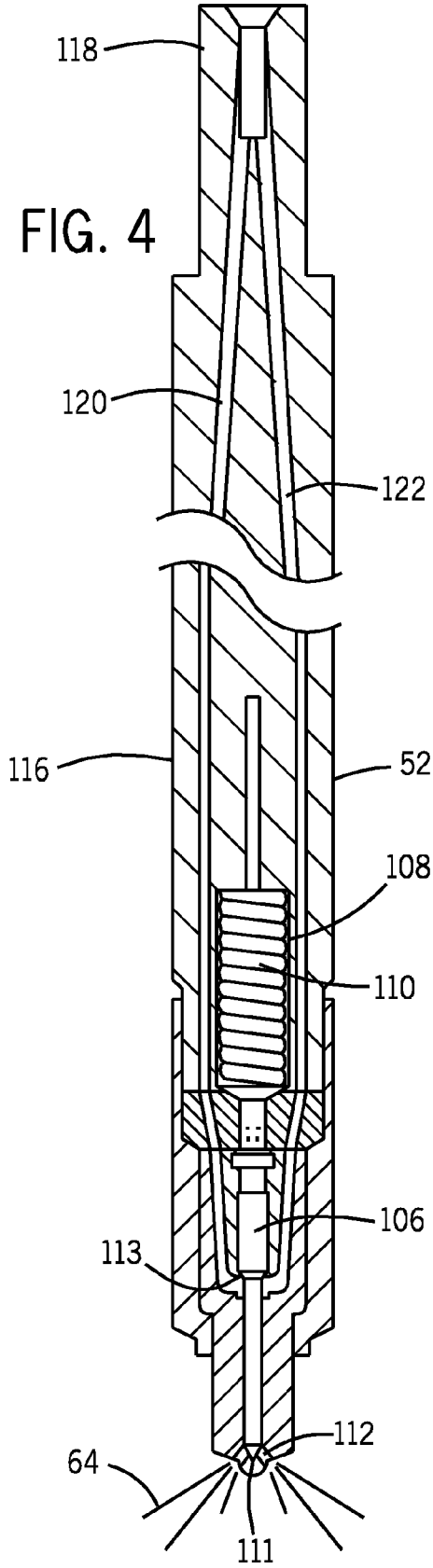
FIG. 4 illustrates a first alternate embodiment of a high pressure fuel injector in accordance with contemplated embodiments of the present invention.

FIG. 4 illustrates a first alternate embodiment of high pressure fuel injector 52. The injector includes a nozzle body 116 having a nozzle coupling 118 to couple the injector to high pressure line 54. Nozzle body 116 further includes a first internal passage 120 and a second internal passage 122 for communicating fuel to needle valve 106. The injector operates in a similar fashion to that of the first embodiment except that it includes a larger internal volume via the plurality of flow paths 120, 122.

As discussed, the internal fuel path of the injector forms part of the internal volume of the injection system 44. Thus, similar to fuel line 54, the internal volume of injector 52 may be configured for higher viscosity fuels. The illustrated fuel injector includes a plurality of flow paths 120, 122 to increase the internal volume of injection system 44. In other words, the designer, manufacturer or engine technician may increase the internal volume of injection system 44 by selecting the fuel injector illustrated in FIG. 4 to replace an injector that does not provide the same plurality of flow paths or internal volume. Again, this provides the flexibility of increasing the internal volume of the injection system via changing the fuel lines, the injector, or a combination thereof.

Figure 5:
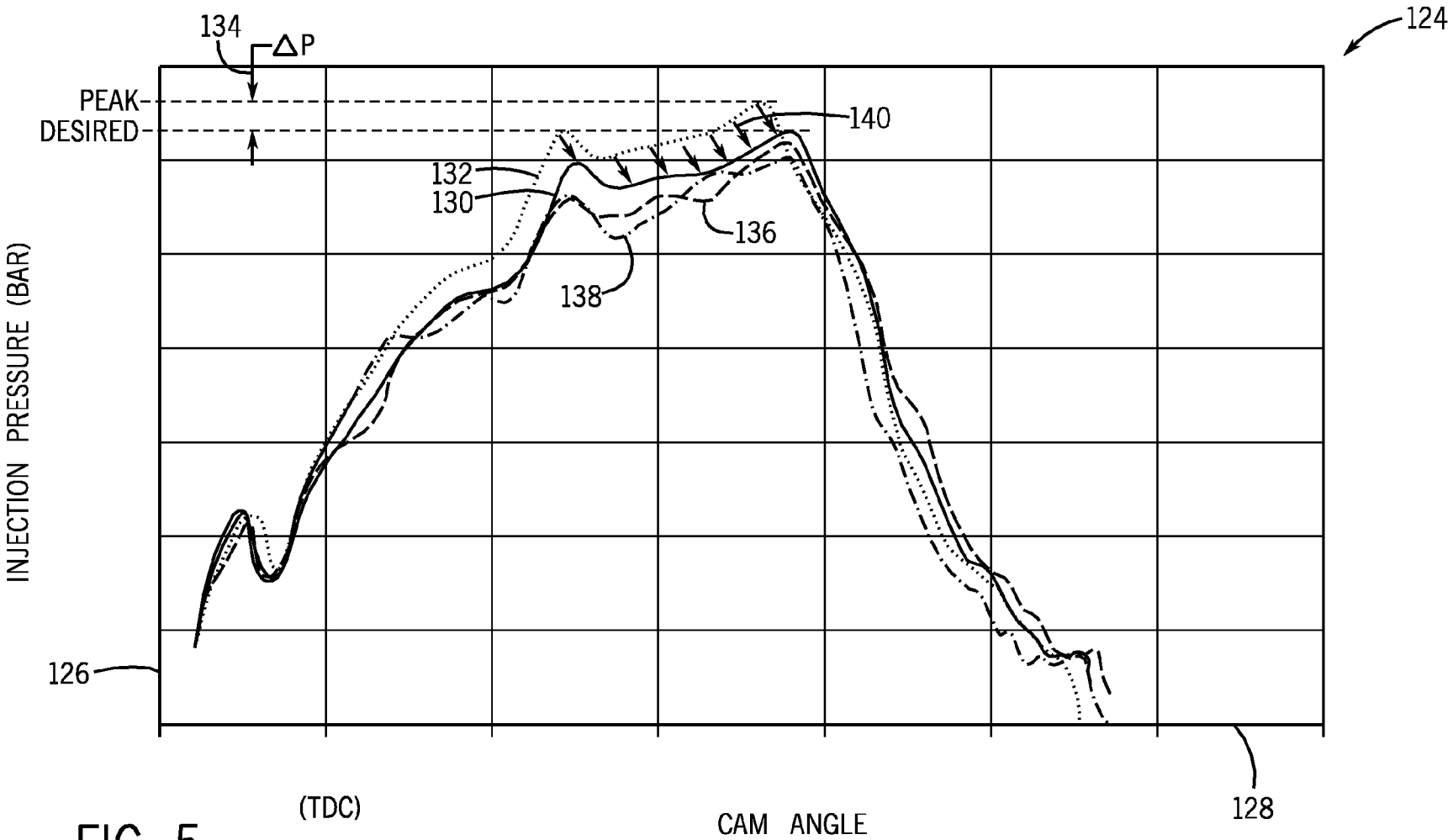
FIG. 5 is graphical representation of exemplary curves illustrating injection pressure when different viscosity fuels are used in embodiments of the present invention.

FIG. 5 is a graphical representation, as indicated by reference numeral 124, of exemplary curves illustrating internal pressures of the injection system when different viscosity fuels are used in accordance with embodiments of the present invention. The pressure curves are illustrated with respect to injection pressure in bars, as indicated by axis 126, versus cam angle in degrees, as indicated by axis 128. Cam angle is indicative of the relative location of piston 58 within combustion chamber 56. For example, zero degree indicates that the piston is at a maximum in-cylinder position or TDC within the combustion chamber. As will be appreciated by those skilled in the art, TDC may be used as a reference point for timing when the injector introduces the fuel into the chamber to ensure maximum combustion efficiency.

As illustrated in FIG. 5, the injection pressure may be a function of the viscosity of the fuel used in the injection system. For example, the injection pressure for an injection system using a diesel fuel having a viscosity of 3 centistokes is illustrated by curve 130. The injection pressure for the same injection system using an MDO or IFO having a viscosity of 11 centistokes is illustrated by curve 132. As indicated, the increase in viscosity of the fuel results in an increase in the peak pressure or an increased delta P, generally represented by reference numeral 134. In other words, the peak pressure of the injection system when operating with the higher viscosity fuel has increased above a desired operating pressure.

FIG. 5 further illustrates that the peak pressure, for the same system using an MDO, may be reduced below the desired operating pressure limit by increasing the internal volume of the injection system. Specifically, curve 136 illustrates the resulting injection pressure when the internal volume of the fuel line is increased via replacing a first fuel line with a second fuel line having a larger inside diameter 92 (see FIG. 2). The larger inside diameter 92 increases the internal volume of the injection system and results in a peak pressure that is lower than the desired operating pressure as illustrated in FIG. 5. Likewise, curve 138 illustrates an injection system using a first alternate embodiment of high pressure nozzle 52 (see FIG. 4) that includes a plurality of flow paths 120, 122 to reduce the peak pressure of the system. In sum, the figure illustrates that the higher viscosity pressure curve 132 approaches the lower viscosity pressure curve 130 when the internal volume of the injection system is increased, generally represented by reference numeral 140. In other words, the same engine may be used with fuels having very different physical properties (e.g., viscosity, density, compressibility) by replacing the fuel line, injector, or both. This provides increased flexibility without increasing the complexity or sacrificing performance of the system.

Figure 6:
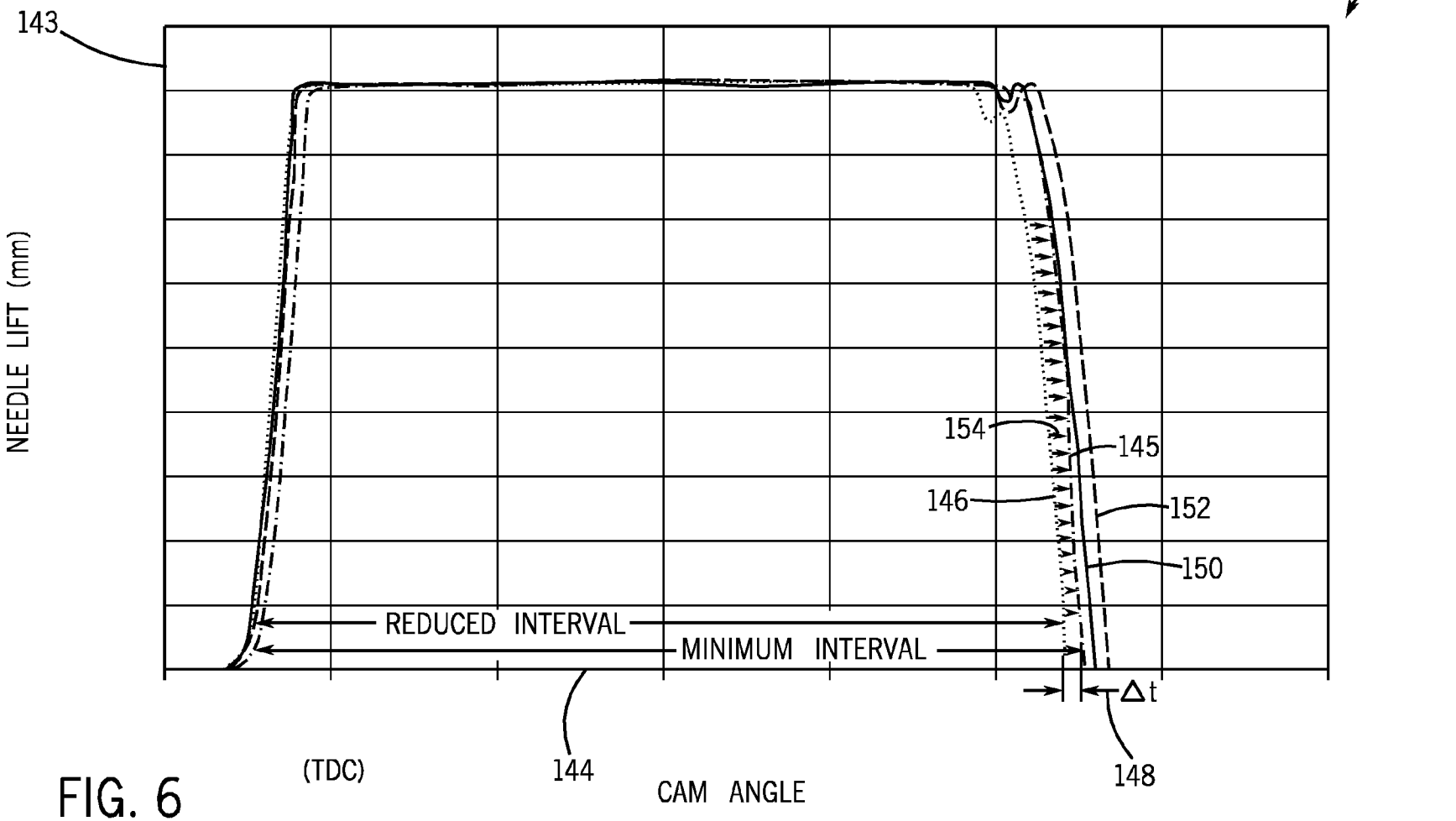
FIG. 6 is graphical representation of exemplary curves illustrating needle lift interval when different viscosity fuels are used in embodiments of the present invention.

FIG. 6 is a graphical representation, as indicated by reference numeral 142, of exemplary curves illustrating needle lift interval of needle 106 (see FIGS. 3 and 4) when different viscosity fuels are used in embodiments of the present invention. The needle lift curves are illustrated with respect to needle displacement in millimeters, as indicated by axis 143, versus cam angle in degrees, as indicated by axis 128. Again, cam angle is indicative of the relative location of piston 58 within combustion chamber 56 and is used to time when the injector introduces the fuel into the chamber. Needle lift is indicative of the interval that needle 106 is displaced from the closed position to the open position. Thus, the needle lift controls the quantity of the pressurized fuel introduced into the combustion chamber.

As illustrated in FIG. 6, the needle lift interval may be a function of the viscosity of the fuel used in the injection system. For example, the needle lift interval for an injection system using a diesel fuel having a viscosity of 3 centistokes is illustrated by curve 145. The injection pressure for the same injection system using an MDO or IFO having a viscosity of 11 centistokes is illustrated by curve 146. The increase in viscosity of the fuel results in a decrease in the needle lift interval or a decreased delta t, generally represented by reference numeral 148. In other words, the amount of pressurized fuel introduced by the injection system is reduced when the system operates with a higher viscosity fuel.

FIG. 6 further illustrates that the needle lift interval, for the same system using an MDO, may be increased back above the desired minimum interval by increasing the internal volume of the injection system. Specifically, curve 150 illustrates the resulting interval when the internal volume of the fuel line is increased via replacing a first fuel line with a second fuel line having a larger inside diameter 92 (see FIG. 2). The larger inside diameter 92 increases the internal volume of the injection system and results in a needle lift interval that exceeds the desired minimum interval as illustrated in FIG. 6. Likewise, curve 152 illustrates an injection system using a first alternate embodiment of high pressure nozzle 52 (see FIG. 4) that includes a plurality of flow paths 120, 122 to increase the needle lift interval of the system. In sum, the figure illustrates that the higher viscosity needle lift curve 146 approaches the lower viscosity needle lift curve 145 when the internal volume of the injection system is increased, generally represented by reference numeral 154. Again, this provides that the same engine may be used with fuels having very different physical properties (e.g., viscosity, density, compressibility) by replacing the fuel line, injector, or both.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. An engine system, comprising:

an internal combustion engine configured to operate by combustion of a first fuel or a second fuel;

a first fuel line configured to be coupled upstream of a combustion chamber of the engine when the engine is operated with the first fuel and to provide a first pressurized volume when installed; and a second fuel line configured to be coupled upstream of the combustion chamber of the engine when the engine is operated with the second fuel and to provide a second pressurized volume when installed;

wherein the first pressurized volume is less than the second pressurized volume and wherein a size of the first pressurized volume is associated with a kinematic viscosity of the first fuel and a size of the second pressurized volume is associated with a kinematic viscosity of the second fuel.

2. The engine system of claim 1, wherein the first fuel is a diesel fuel, a number 1 diesel fuel, or a number 2 diesel fuel, and the second fuel is a marine diesel fuel, marine diesel oil, intermediate fuel oil, residual fuel oil, marine gas oil, or vegetable oil.

3. The engine system of claim 1, wherein the kinematic viscosity of the first fuel is between 1 to 6 centistokes at 40 degree centigrade and the kinematic viscosity of the second fuel is between 6 to 15 centistokes at 40 degree centigrade.

4. The engine system of claim 1, wherein the first volume is between approximately 3000 to 3300 cubic millimeters and the volume of the second fuel line is between approximately 5000 and 5300 cubic millimeters.

5. The engine system of claim 1, wherein the first and second volumes include an internal volume of an injector assembly.

6. The engine system of claim 5, wherein the injector assembly includes a plurality of flow paths.

7. The engine system of claim 1, where the first and second volumes provide a needle lift interval greater than a minimum needle lift interval when the engine is operated with the first and second fuels, respectively.

8. The engine system of claim 7, wherein the minimum needle lift interval is approximately 5 as measured with respect to an angle of a fuel cam of the internal combustion engine.

9. An engine system, comprising:

an internal combustion engine configured to operate by combustion of a first fuel or a second fuel; and a fuel line configured to be coupled upstream of a combustion chamber of the engine and to provide a pressurized volume when installed, the fuel line being selected from two interchangeable fuel lines with different internal volumes based upon whether the engine is operated with the first fuel or the second fuel, wherein a first of the two interchangeable fuel lines comprises a first internal volume that is less than a second internal volume associated with a second of the two interchangeable fuel lines and wherein a size of the first internal volume is associated with a kinematic viscosity of the first fuel and a size of the second internal volume is associated with a kinematic viscosity of the second fuel.

10. The engine system of claim 9, wherein the first fuel is a diesel fuel, a number 1 diesel fuel, or a number 2 diesel fuel, and the second fuel is a marine diesel fuel, marine diesel oil, intermediate fuel oil, residual fuel oil, marine gas oil, or vegetable oil.

11. The engine system of claim 9, wherein the kinematic viscosity of the first fuel is between 1 to 6 centistokes at 40 degree centigrade and the kinematic viscosity of the second fuel is between 6 to 15 centistokes at 40 degree centigrade.

12. The engine system of claim 9, wherein the internal volume of the first of the two interchangeable fuel lines is between approximately 3000 to 3300 cubic millimeters and the volume of the second of the two interchangeable fuel lines is between approximately 5000 and 5300 cubic millimeters.

13. The engine system of claim 9, wherein each internal volume includes an internal volume of an injector assembly.

14. The engine system of claim 13, wherein the internal volume of the injector assembly includes a plurality of flow paths.

15. A method for configuring an internal combustion engine, comprising:

selecting a fuel line configured to be coupled upstream of a combustion chamber of the engine and to provide a pressurized volume when installed, the fuel line being selected from two interchangeable fuel lines with different internal volumes based upon whether the engine is operated with a first fuel or a second fuel, wherein a first internal volume associated with a first of the two interchangeable fuel lines is less than a second internal volume associated with a second of the two interchangeable fuel lines and wherein a size of the first internal volume is associated with a kinematic viscosity of the first fuel and a size of the second volume internal is associated with a kinematic viscosity of the second fuel; and installing the fuel line on the engine.

16. The method of claim 15, wherein the fuel line is selected based on the first fuel including a diesel fuel, a number 1 diesel fuel, or a number 2 diesel fuel, and the second fuel including a marine diesel fuel, marine diesel oil, intermediate fuel oil, residual fuel oil, marine gas oil, or vegetable oil.

17. The method of claim 15, wherein selecting the fuel line includes selecting an injector assembly that includes a plurality of flow paths.

18. A method for configuring an internal combustion engine, comprising:

removing a first fuel line from the engine, the first fuel line being coupled upstream of a combustion chamber of the engine when the engine is operated with the first fuel and to provide a first pressurized volume when installed; and installing a second fuel line in place of the first fuel line, the second fuel line being configured to be coupled upstream of the combustion chamber of the engine when the engine is operated with the second fuel and to provide a second pressurized volume when installed;

wherein the first pressurized volume is less than the second pressurized volume and wherein a size of the first pressurized volume is associated with a kinematic viscosity of the first fuel and a size of the second pressurized volume is associated with a kinematic viscosity of the second fuel.

19. The method of claim 18, wherein the first fuel line is selected based on the first fuel including a diesel fuel, a number 1 diesel fuel, or a number 2 diesel fuel, and the second fuel line is selected based on the second fuel including a marine diesel fuel, marine diesel oil, intermediate fuel oil, residual fuel oil, marine gas oil, or vegetable oil or vice versa.

20. The method of claim 18, wherein the pressure is at least approximately 1000 bar.

* * * * *